US008820890B2

(12) United States Patent
Ishibashi et al.

(10) Patent No.: US 8,820,890 B2
(45) Date of Patent: Sep. 2, 2014

(54) HEAD MAINTENANCE DEVICE AND INKJET RECORDER

(75) Inventors: Daisuke Ishibashi, Hino (JP); Kazuo Asano, Hino (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 13/883,463

(22) PCT Filed: Oct. 31, 2011

(86) PCT No.: PCT/JP2011/075024

§ 371 (c)(1),
(2), (4) Date: May 3, 2013

(87) PCT Pub. No.: WO2012/060310

PCT Pub. Date: May 10, 2012

(65) Prior Publication Data

US 2013/0222478 A1 Aug. 29, 2013

(30) Foreign Application Priority Data

Nov. 4, 2010 (JP) ..... 2010-247254

(51) Int. Cl.
*B41J 2/165* (2006.01)

(52) U.S. Cl.
USPC ..... 347/33

(58) Field of Classification Search
CPC .... B41J 2/165; B41J 2/16532; B41J 2/16535; B41J 2/16536; B41J 2/16544
USPC ..... 347/47, 22, 33, 20, 32
See application file for complete search history.

(56) References Cited

U.S. PATENT DOCUMENTS

2010/0214355 A1 8/2010 Inoue

FOREIGN PATENT DOCUMENTS

| | | | |
|---|---|---|---|
| JP | 11-129503 | A | 5/1999 |
| JP | 2003-182097 | A | 7/2003 |
| JP | 2003-205621 | A | 7/2003 |
| JP | 2005-21809 | A | 1/2005 |
| JP | 2006-205712 | A | 8/2006 |
| JP | 2007-90689 | A | 4/2007 |
| JP | 2007-169556 | A | 7/2007 |
| JP | 2010188707 | A | 9/2010 |

OTHER PUBLICATIONS

International Preliminary Report on Patentability for International Application No. PCT/JP2011/075024, issued May 7, 2013.
International Preliminary Report on Patentability for International Application No. PCT/JP2011/075024, issued May 14, 2013.
Written Opinion of the International Searching Authority for International Application No. PCT/JP2011/075024, mailed Nov. 29, 2011, with English translation.
International Search Report for International application No. PCT/JP2011/075024, Nov. 29, 2011, with English translation.
Extended European Search Report for the EP application No. 11837960.1. Dated May 24, 2014.

*Primary Examiner* — Lamson Nguyen
(74) *Attorney, Agent, or Firm* — Cantor Colburn LLP

(57) ABSTRACT

A head maintenance device includes a wiping section which wipes a nozzle plane, on which a plurality of nozzles to eject ink are provided, of an inkjet head. The wiping section includes a wiping member including a cloth, an elastic body and a support, in the order named from a side where the wiping section comes into contact with the inkjet head. The cloth is moved parallel to the nozzle plane at a relative moving velocity of not less than RMV×0.2 and not more than RMV×0.9 with respect to the nozzle plane so as to wipe the nozzle plane.

7 Claims, 6 Drawing Sheets

HEAD MAINTENANCE DEVICE AND INKJET RECORDER

CROSS REFERENCE TO RELATED APPLICATIONS

This is the U.S. national stage of application No. PCT/JP2011/075024, filed on 31 Oct. 2011. Priority under 35 U.S.C. §119(a) and 35 U.S.C. §365(b) is claimed from Japanese Application No. 2010-247254, filed 4 Nov. 2010, the disclosure of which is also incorporated herein by reference.

TECHNICAL FIELD

The present invention relates to a head maintenance device and an inkjet recorder.

BACKGROUND ART

As image recording means, an image recorder using an inkjet method (hereinafter referred to as an "inkjet recorder") has been widely used which ejects ink from inkjet heads to form images.

In such an inkjet recorder, when a recording operation is continuously performed, the ink sprayed from the ejection holes of the inkjet heads adheres and is accumulated on the ink ejection planes and near the ejection holes. This sometimes causes clogging of the ejection holes. When a recording operation is performed under such circumstances, there is a danger that the ink may not be properly ejected, which causes a problem with image recording.

Therefore, the inkjet heads needs appropriate maintenance for proper image recording.

As a method of maintenance, there is a method to wipe an ink ejection plane with a wiping member. A blade made of silicon rubber or the like is generally used as the wiping member.

Recently, with the spread of the application of inkjet recording, inks are developed which can be used for recording on an ink non-absorbable recording medium. Since common inks used for recording on a non-absorbable recording medium is not fixed well, many of such inks for a non-absorbable recording medium contain a lot of resin and have a high viscosity, or have an increased viscosity when cured with external energy such as UV (ultraviolet light) on a recording medium, in order to be well-fixed.

When such an ink adheres around the nozzles on a nozzle plate and the solvent is evaporated, or when the ink which has adhered cures, the viscosity increases. In such a case, it is difficult to wipe the ink off with a blade at the time of maintenance of heads, and in some cases, the ink having increased viscosity may be pushed into the nozzles with the blade.

Patent Literature 1 describes an inkjet recorder wherein the RMV value of ink on a nozzle plane falls within a specific range and wherein the nozzle plane is wiped with a porous blade. The inkjet recorder described in Patent Literature 1 thus leaves no ink remaining to be wiped and prevents the nozzle planes from being damaged. The ink used in the apparatus described in Patent Literature 1, however, is a common water-based ink, and the application of ink for a non-absorbable recording medium is not taken into consideration. When an ink for non-absorbable recording medium adheres to the nozzle planes and sticks thereto fast to some extent, the viscosity of the ink increases. In such a case, the ink cannot be wiped off in the method mentioned above. When the blade is pressed at higher pressure to forcibly remove the ink, the water-repellent layers of the nozzle planes are damaged.

Patent Literature 2 describes pressing a cloth against nozzle planes with a pressing member without moving the cloth on the nozzle planes, which enables the ink to be wiped off without damaging the water-repellent layers of the nozzle planes. Further, Patent Literature 2 describes sucking ink from nozzles with foreign substances to overcome a failing nozzle.

When a prolonged printing causes the ink, which has adhered to the nozzle planes, to cure to some extent, however, the ink cannot be completely removed by merely pressing the cloth against it, and remains as a semisolid substance. When the semisolid substance exists near ink ejection holes, a problem of deformation of the meniscus shape of ink occurs, leading to curving of the ejections.

PRIOR ART LITERATURES

Patent Literatures

Patent Literature 1: Japanese Patent Publication Laid-Open No. 2003-182097

Patent Literature 2: Japanese Patent Publication Laid-Open No. 2006-205712

DISCLOSURE OF INVENTION

Problems to be Solved by the Invention

An object of the present invention is to provide a head maintenance device and an inkjet recorder that can wipe off the uncured ink and the ink which have adhered to the nozzle planes and have partially cured, without leaving the ink on the nozzle planes; and that prevents the water-repellent layers of the nozzle planes from being damaged.

Means for Solving Problems

The object of the present invention has achieved by the following means.

1. A head maintenance device comprising a wiping section which wipes a nozzle plane, on which a plurality of nozzles to eject ink are provided, of an inkjet head, wherein the wiping section includes a wiping member comprising a cloth, an elastic body and a support, in the order named from a side where the wiping section comes into contact with the inkjet head; and wherein the cloth is moved parallel to the nozzle plane at a relative moving velocity of not less than RMV×0.2 and not more than RMV×0.9 with respect to the nozzle plane so as to wipe the nozzle plane.

2. The head maintenance device according to the above 1, wherein the ink is a curable ink.

3. The head maintenance device according to the above 1 or 2, wherein the elastic body is a foamed resin.

4. The head maintenance device according to the above 3, wherein the foamed resin has a hardness of not less than 10 N and not more than 180 N.

5. The head maintenance device according to any one of the above 1 to 4, wherein the cloth contains a polyester fiber.

6. The head maintenance device according to any one of the above 1 to 5, wherein the cloth contains a polyamide fiber.

7. The head maintenance device according to any one of the above 1 to 6, wherein a water-repellent finishing is performed on the nozzle plane.

8. An inkjet recorder comprising the head maintenance device according to any one of the above 1 to 7.

Effects of the Invention

There is provided a head maintenance device and an inkjet recorder that can wipe off the uncured ink and the ink which have adhered to the nozzle planes and have cured to some extent, without leaving the ink on the nozzle planes; and that prevents the water-repellent layers of the nozzle planes from being damaged.

EMBODIMENT FOR CARRYING OUT THE INVENTION

Explanations are given below about a head maintenance device and an inkjet recorder which includes the head maintenance device in accordance with the present invention.

Figure 1:
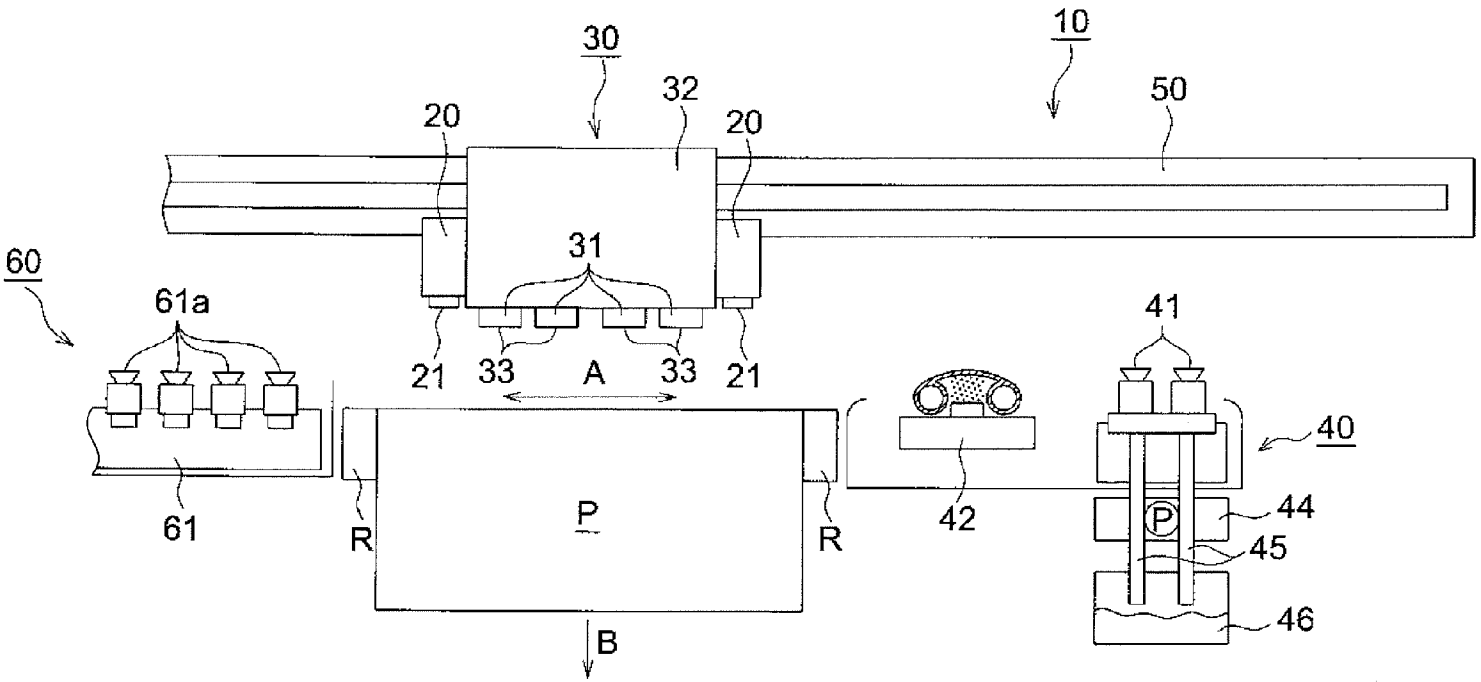
FIG. 1 is a view showing an example of an inkjet recorder including a head maintenance device in accordance with the present invention.

A serial-type inkjet recorder, which is illustrated in FIG. 1 as an embodiment, is described. The section indicated by the reference number of 40 in FIG. 1 is a head maintenance device.

The ink is preferably a curable ink, which is fixed well at the time of recording on a non-absorbable recording medium. Examples of curable inks include a UV curable ink, an electron beam curable ink and a heat curable ink. Above all, UV curable ink is preferable.

An inkjet recorder 10 illustrated by the present embodiment preferably performs printing by ejecting UV ink onto a recording medium, and after that, irradiates the ink with UV by a UV irradiation sections 20 to cure and fix the ink.

As shown in FIG. 1, the main components of the part, which performs printing, of the inkjet recorder 10 includes a conveying section (not shown) which conveys a recording medium (here, recording paper P) forward at the time of printing; a printing unit 30 which includes a carriage 32 having a plurality of inkjet heads (heads) 31 to eject UV ink onto a recording medium (here, recording paper P); a head maintenance device 40 which maintains the inkjet heads 31 of the printing unit 30; a guide rail 50 which guides the carriage 32 in the direction (arrow A) parallel to a recording medium at the time of printing, maintenance or the like; and a home position 60 where the carriage 32 stands by.

The conveying section conveys a recording paper P on the platen R to coincide with the operation of the carriage 32 at the time of printing, and conveys the recording paper P downwards (arrow B) from the platen R at the end of printing.

As described above, the printing unit 30 includes the inkjet heads 31, the carriage 32 and the like.

The inkjet heads 31 have a plurality of ejection holes of ink nozzles to eject ink. The ejection holes are provided on the surfaces (nozzle planes 33), which face a recording paper P, of the inkjet heads 31.

The carriage 32 is provided with the plurality of inkjet heads 31 for the respective colors (here, yellow, magenta, cyan and black).

The carriage 32 is movable along the guide rail 50 in the direction of arrow A from the head maintenance device 40 (described later) through the printing area facing a recording paper P above the platen R to the home position 60.

The head maintenance device 40 includes the wiping section 42.

The head maintenance device 40 preferably includes suction caps 41 which suck ink from the ejection holes while sealing the nozzle planes 33 of the inkjet heads 31 and covering the ejection holes; and the wiping section 42 which slides on the nozzle planes 33 to wipe off residual ink on the nozzle planes 33 after the ink is sucked by the suction caps 41. The suction caps 41 and the wiping section 42 are preferably provided integrally with each other on the upper surface (i.e., the surface facing the ejection holes of the inkjet heads 31).

A plurality of suction caps 41 (two in the present embodiment) are provided side by side, and can suck a plurality of inkjet heads 31 at one time at the time of maintenance. It is preferable that the suction caps 41 be connected with a suction pump (suction section) 44, which sucks the spaces formed by the suction caps 41 and the nozzle planes 33, and with air communication valves (not shown), via tubes 45 under the suction caps 41. Suction by the suction pump 44 is controlled by a control unit (not shown). Specifically, the suction pump 44 sucks the ejection holes covered with the suction caps 41 via the suction caps 41. The ink sucked by the suction pump 44 from the ejection holes is discharged to a waste ink tank 46.

Although the suction section in the present embodiment is illustrated by the suction pump 44, the suction section may be of any type as long as it sucks ink from the ejection holes of the ink nozzles. For example, the suction section may be a piston and cylinder. Further, the ink may be discharged away by driving the inkjet heads instead of being sucked.

At the home position 60, caps 61*a* which are equal in number to the inkjet heads 31 are provided to protect the nozzle planes 33. The caps 61*a* constitute a cap mechanism 61. The caps 61*a* preferably cover and seal the nozzle planes 33 of the inkjet heads 31 while the carriage 32 is on standby.

In the present embodiment, the carriage 32 of the printing unit 30 is preferably provided with a UV irradiation section 20. The UV irradiation section 20 is provided on the rear side of the carriage 32 in the direction of movement at the time of printing. In the present embodiment, in particular, since the printer performs printing in both directions, the UV irradiation section 20 is provided at each end of the carriage 32 in the direction of movement (arrow A).

The UV irradiation sections 20 irradiate the UV ink, which is ejected from the inkjet heads 31 of the printing unit 30 onto a recording paper P, with UV to cure and fix the ink. The UV irradiation sections 20 are provided on the surface which faces a recording paper P, similarly to the nozzle planes 33 having the ejection holes of the ink nozzles. As the UV irradiation sections 20, various types of items, such as UV lamps, which can irradiate a recording paper P with UV may be employed.

Here, the UV irradiation sections 20 include shutter mechanisms 21 which separate the light sources of the UV irradiation sections 20 from the outside. When the carriage 32 enters the area of a recording medium (more specifically, when the area to be irradiated by the UV irradiation section on the rear side with respect to the direction of carriage movement, among the two UV irradiation sections 20, comes into the area of a recording medium), the shutter of the shutter mechanism 21 on the UV irradiation section on the rear side with respect to the direction of carriage movement is opened to start UV irradiation.

When the carriage 32 enters the area except the area of a recording medium (i.e., the area of the head maintenance device 40 or the area of the cap mechanism 61 of the home position 60) (more specifically, when the area to be irradiated by the UV irradiation section on the rear side with respect to the direction of carriage movement, among the two UV irradiation sections 20, comes into the area except a recording medium), the shutter of the shutter mechanism 21 on the UV irradiation section on the rear side with respect to the direction of carriage movement is closed to stop UV irradiation.

When maintenance of the nozzle plates of the inkjet heads is performed by wiping the plates with a cloth, the inkjet heads are moved along the guide rail 50 to the position facing the wiping section 42 of the head maintenance device 40. After the inkjet heads stop moving, the wiping section 42 moves toward the inkjet heads and presses the cloth 72 against the nozzle planes 33. The wiping section is moved parallel to the nozzle planes, with the inkjet heads at rest and with the relative position of the cloth and the elastic body fixed. The wiping member is thereby moved relative to and parallel to the nozzle planes to slide on the nozzle planes. In this way, the ink adhering to the nozzle planes is wiped.

The wiping may be performed after the inkjet heads are sucked at the positions of the suction caps, or may be preformed after the ink is discharged away by driving the inkjet heads.

The wiping section 42 is described with reference to FIGS. 2A and 2B.

The wiping section 42 includes a support 70, to which roll cores 71*a* and 71*b* are attached, and the cloth 72. The cloth 72, which is a wiping member, is wound around the roll cores 71*a* and 71*b*. The cloth 72 is let out from the roll core 71*a* and is reeled by the roll core 71*b*. An elastic body 73 is disposed between the cloth 72, which is stretched between the roll cores 71*a* and 71*b*, and the support 70. The elastic body 73 is fixed to the support 70. The cloth 72 and the elastic body 73 are slidable with respect to each other. The elastic body 73 pushes up the cloth to have a convex shape in the direction away from the support 70.

To rotate the roll cores 71*a* and 71*b*, belts 74*a* and 74*b* are laid on pulleys 76*a* and 76*b* connected to the roll cores 71*a* and 71*b*, respectively, and the belts are connected to a driving device at portions which are not shown.

A pillar 75 is connected to the support 70. The pillar 75 is connected to a movement device (see FIG. 7A and FIG. 7B) provided in the head maintenance device 40 or the inkjet recorder. The pillar 75 supports the wiping section 42, moves the wiping section 42 up and down, and transmits a force to control the position.

Figure 7A:
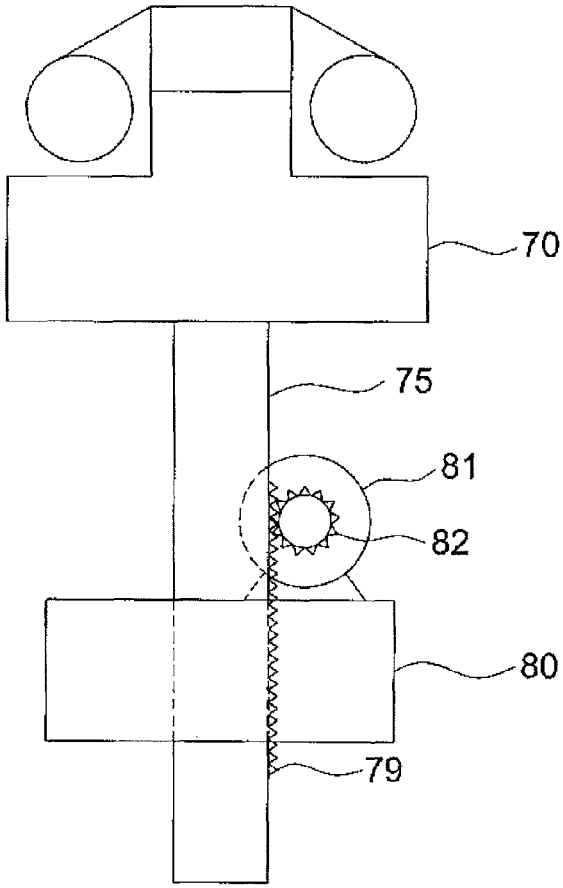
FIG. 7A is a front view showing a movement mechanism of the wiping section.
Figure 7B:
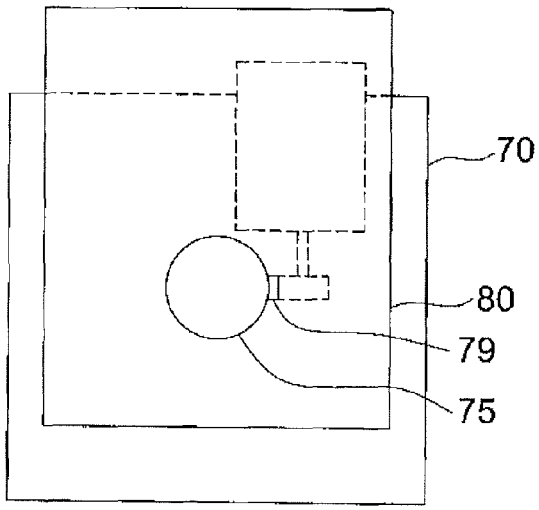
FIG. 7B is a bottom view showing the movement mechanism of the wiping section.

FIGS. 7A and 7B show the mechanism to move the wiping section up and down. The pillar 75 penetrates a guide plate 80, with the pillar 75 and the guide plate 80 slidable with respect to each other. The guide plate 80 is fixed to the head maintenance device 40 or the inkjet recorder. The pillar is provided with linearly-arranged teeth 79 which engage with a gear 82 connected with a motor 81.

Rotation of the motor 81 can move the pillar and the wiping section up and down. Controlling the number of rotations of the motor 81 can control the distance between the position where the wiping member comes into contact with the inkjet heads and the position to which the wiping section is pushed. The elastic body is moderately compressed and presses the wiping member against the nozzle planes at a uniform and moderate pressure.

The wiping section can be moved relative to and parallel to the nozzle planes by moving the wiping section or by moving the inkjet heads. Moving the inkjet heads requires a simpler mechanism, and therefore, is preferable.

The cloth 72 can perform wiping multiple number of times with the same part thereof. When the wiping ability declines after using multiple numbers of times, a power device is driven to move the belts, and rotates the roll cores 71*a* and 71*b* to draw out an unused area of the cloth 72. Thus, the original wiping ability is regained.

(Cloth)

The cloth may be any one of an unwoven cloth and a woven cloth. The fiber composing the cloth is preferably composed of one of polyester, acrylic and polyamide or the material of a combination thereof because these are less likely to damage the nozzle planes. Above all, polyester is preferable, and the material of combined polyester and polyamide is the most preferable. As a polyamide fiber, a nylon fiber may be employed, for example.

The fiber is preferably formed of a microfiber of 0.5 denier or less.

(Elastic Body)

As the elastic body, foamed resin, silicon rubber, EPDM or fluoro-rubber may be used. Above all, foamed resin is preferable because it is less likely to damage the nozzle planes, and foamed polyurethane is more preferable among foamed resins.

The foamed resin preferably has a hardness of not less than 10 N and not more than 180 N, and more preferably, has a hardness of not less than 30 N and not more than 180 N. The hardness of 10 N or more can press the cloth against the nozzle planes at sufficiently high pressure, and therefore, does not leave uncured or partially cured ink remaining to be wiped. The hardness of 180 N or less can bring the cloth into close contact with the nozzle planes at a uniform pressure, and therefore, does not leave uncured or partially cured ink remaining to be wiped.

The hardness of the foamed resin is obtained in the following way, which is a standard of a foam rubber for cushion.

1. Foam is flatly placed and a circular pressure plate which is 200 mm in diameter is laid thereon.

2. The pressure plate is pressed down to 75% of the original thickness of the foam, and then, is restored.

3. The pressure plate is pressed again down to 25% of the original thickness, and the load value after keeping the pressure plate at rest for 20 seconds is obtained, the load value being expressed in N (Newton).

(Support)

The support may be provided with a built-in power source to rotate the roll cores 71*a* and 71*b*. The support is provided with bearings 77*a* and 77*b* which rotatably support shafts 78*a* and 78*b* of the roll cores.

The support supports the elastic body 73 and applies pressure from below to the elastic body 73 and the cloth 72 toward the nozzle planes when the support gets closer to the nozzle planes.

The bearings 77*a* and 77*b* and the elastic body 73 are preferably disposed on the same support 70. That is because such a structure can easily perform control to maintain a constant distance between each of the roll cores 71*a* and 71*b* and the elastic body 73 at the time of maintenance to maintain the cloth 72 stretched tight all the time.

Figure 3:
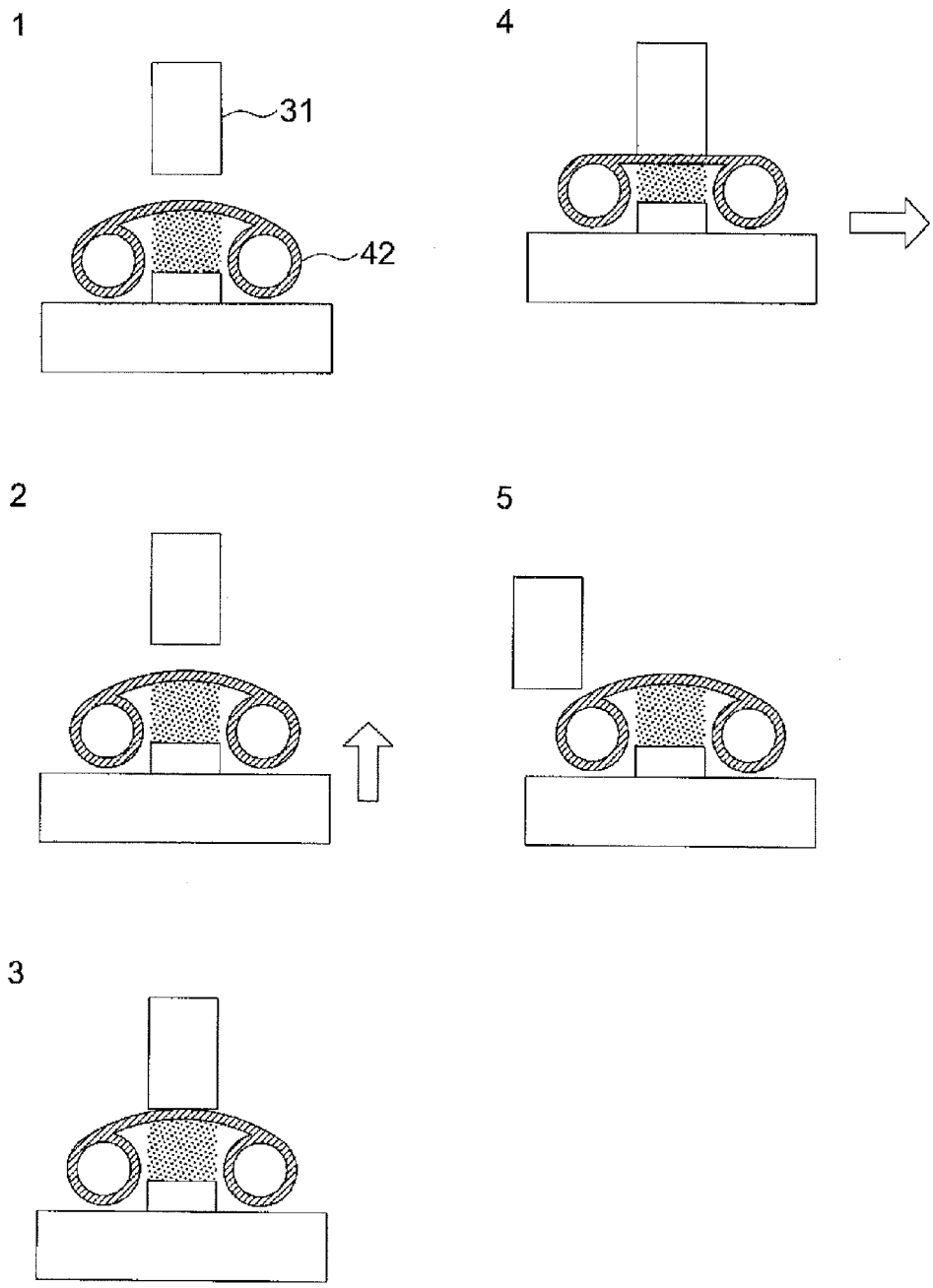
FIG. 3 is a view showing a movement of the wiping section.

The views 1-5 in FIG. 3 show the operations of wiping the nozzle planes of the inkjet heads 31 with the wiping section 42. The operations of the views 1-5 are described below.

1. The inkjet heads 31 move along the guide rail 50 to the position where the inkjet heads 31 faces the wiping section 42.

2. The wiping section 42 is raised and comes closer to the nozzle planes 33 of the inkjet heads.

3. The cloth 72 of the wiping section 42 comes into contact with the nozzle planes 33 of the inkjet heads.

4. The wiping section 42 is further raised, the elastic body 73 is compressed, and the cloth 72 is pressed against the nozzle planes 33 with the repulsive force of the elastic body.

5. The wiping section 42 moves relative to and parallel to the nozzle planes with the cloth 72 being pressed against the nozzle planes 33. At this time, the cloth, which is a wiping member, slides relative to the nozzle planes, with the roll cores 71*a* and 71*b* at rest and with the relative position of the cloth 72 and the elastic body 73 fixed.

Thus, the operations 1-5 can remove even the ink which has adhered to the nozzle planes and is partially cured without damaging the nozzle planes.

Here, the relative moving velocity of the cloth 72, which is a wiping member with respect to the nozzle planes is not less than 0.2 times the value of the RMV and not more than 0.9 times the value of the RMV. The cloth draws the ink out of the nozzles, and the drawn ink tends to remain on the nozzle planes. When the moving velocity is more than 0.9 times the value of the RMV, ink drops remain on the route along which the cloth, which has passed the nozzles, has moved. On the other hand, when the relative moving velocity of the cloth 72, which is a wiping member, with respect to the nozzle planes is less than 0.2 times the value of the RMV, a mechanical backlash occurs owing to instability in control and engagement of gears with a drive system, such as a motor, running at a low speed. This hinders partially-solid ink on the nozzle planes from being wiped and causes the ink to remain.

(RMV)

Figure 4A:
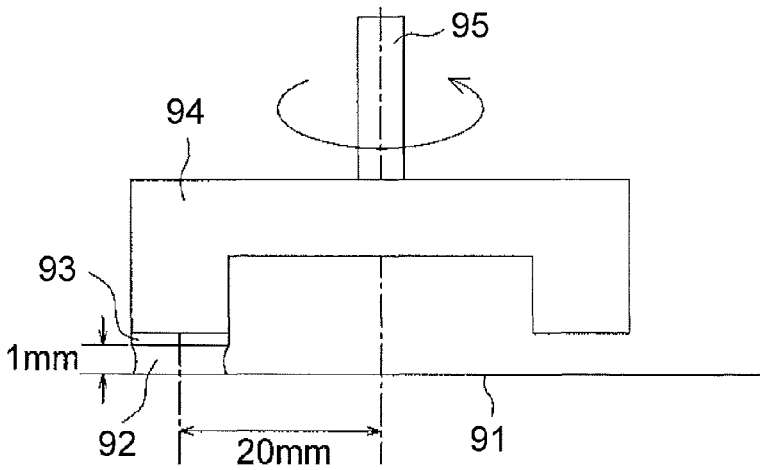
FIG. 4A is a view showing an RMV measurement device.
Figure 4B:
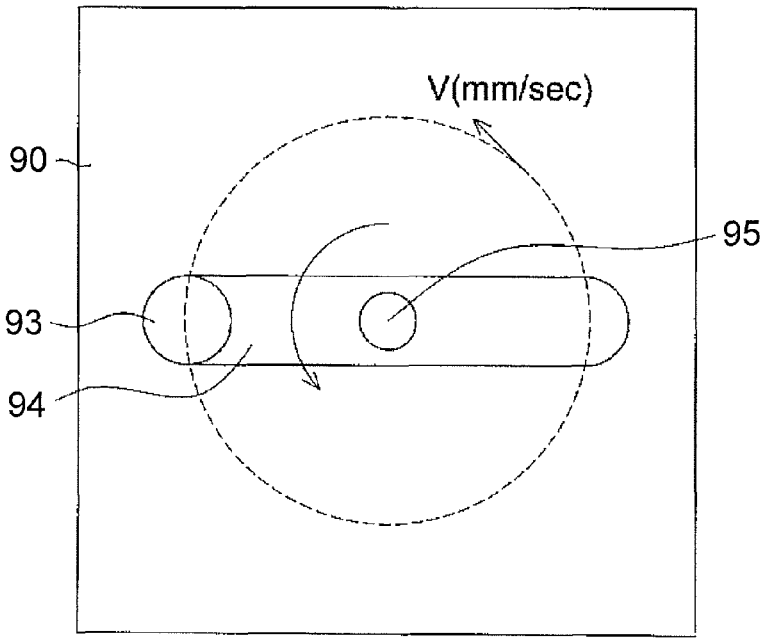
FIG. 4B is a view showing the RMV measurement device.

Here, the method for measuring the RMV (receding meniscus velocity) is described with reference to FIGS. 4A and 4B.

Ink 92 having a volume of 25 μl, whose receding meniscus velocity is to be measured, is put on a water-repellent layer 91 of a water-repellent sheet 90. The ink 92 is retained in the interval of 1 mm between a rubber member 93 (6 mmϕ), which is attached to an arm 94 and whose lower surface has hydrophily, and the water-repellent layer. The rubber member 93 is rotated about the rotation axis 95 at a circumferential velocity (V mm/sec) such that the center of the rubber member 93 forms a circle with a radius of 20 mm. The circumferential velocity is varied and a maximum velocity at which the ink keeps pace with the rubber member 93 is measured. The velocity at which the ink keeps pace with the rubber member 93 means the maximum velocity at which residual ink is not visually observed at the route along which the rubber has passed.

Here, an inkjet head 31 which is maintained by the head maintenance device is described with reference to FIGS. 5 and 6.

The inkjet head 31 is substantially formed in the shape of a cuboid, and includes the nozzle plate 12 on which a plurality of nozzles 13 to eject ink are formed. Water repellent processing is preferably performed on the ink ejection plane 33 by forming a water-repellent layer 12*a* containing a fluorine resin such as an FEP (fluorinated ethylene propylene resin) thereon so that ink will not adhere easily. The type of the inkjet head 31 and the color and type of ink to be ejected are not particularly limited.

The inkjet head 31 is preferably of a shear mode type where many ink channels 18 (partially shown) are arranged between the cover plate 14 and the substrate 16. The ink channels 18 are separated with one another with a plurality of partition walls 17 (partially shown) each of which is made of piezoelectric material such a PZT, which is an electromechanical converter.

The ink in an ink tank (not shown) is introduced through an ink tube 11 and an ink supplying hole 15 into an inkjet head 31.

(Ink)

The ink is preferably an ink applicable to a non-absorbable recording medium because the present invention is particularly effective for a partially cured ink on nozzle planes. The ink is preferably a curable ink, in particular, and the present invention shows a remarkable effect in the case of a UV curable ink, above all.

EXAMPLES

The present invention is illustrated in detail by examples below. The word "parts" below means "parts by mass" unless otherwise noted.

<Production of Inkjet Head>

Figure 5:
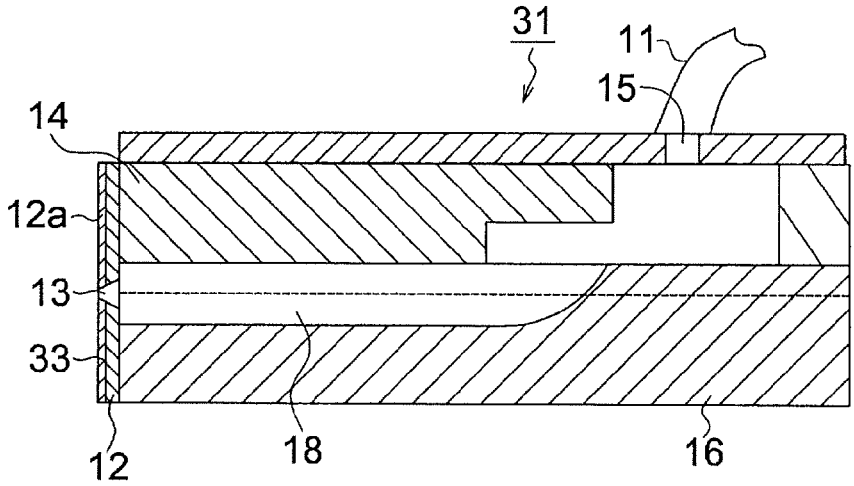
FIG. 5 is a cross-sectional view of an inkjet head.
Figure 6:
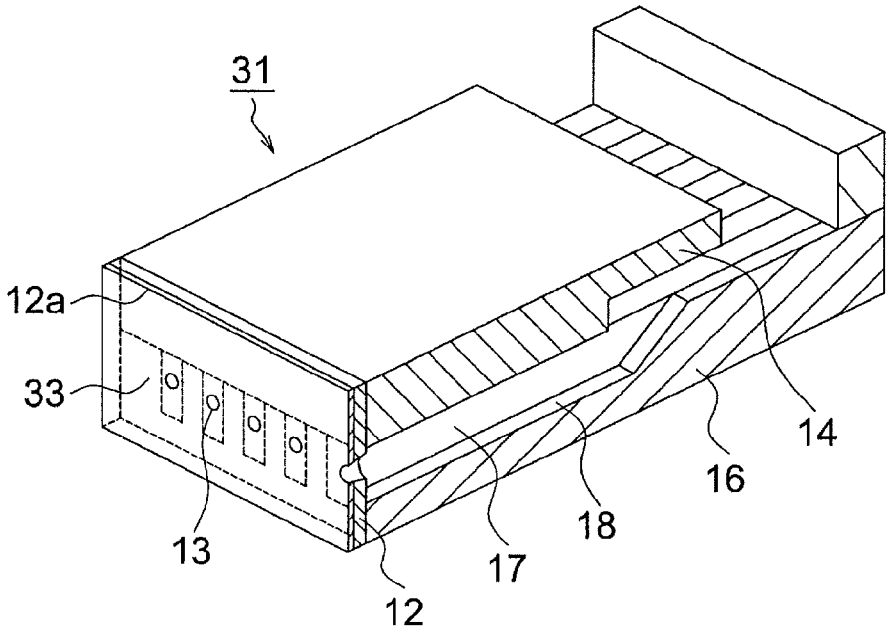
FIG. 6 is a perspective view of the inkjet head.

FIGS. 5 and 6 area cross-sectional view and a perspective view, respectively, of a produced inkjet head.

In the drawings, the reference number 31 indicates an inkjet head, the reference number 11 indicates an ink tube, the reference number 12 indicates a nozzle plate, the reference number 13 indicates a nozzle, the reference number 14 indicates a cover plate, the reference number 15 indicates a ink supplying hole, the reference number 16 indicates a substrate, and the reference number 17 indicates a partition wall. Ink channels 18 are formed by the partition walls 17, the cover plate 14 and the substrate 16. A water-repellent layer 12*a* is provided on the surface of the nozzle plate 12.

The inkjet head 31 is of a shear mode type where many ink channels 18 (partially shown) are arranged between the cover plate 14 and the substrate 16. The ink channels 18 are separated with one another with a plurality of partition walls 17 (partially shown) each of which is made of piezoelectric material such a PZT, which is an electromechanical converter.

Although FIG. 5 is a simplified drawing where the number of nozzles is reduced, the inkjet head used here has 512 nozzles, and has a nozzle resolution of 360 dpi.

The inkjet head 31 was produced in such a way that a nozzle plate (described below) was bonded to the head chip constituted of the substrate 16, the partition walls 17, the ink channels 18 and the cover plate 14.

<Production of Nozzle Plate>

(Water Repellent Processing)

An aqueous FEP dispersion liquid (ND-1, made by DAIKIN INDUSTRIES, LTD.); a water-soluble polyamide-imide resin (HPC-1000, made by HITACHI CHEMICAL CO., LTD.); and an ultraviolet absorbing agent (Needlal P-10, made by TAKI CHEMICAL CO., LTD.) were added to water to prepare an application liquid. The solid content of the FEP was 10% by mass, the solid content of the water-soluble polyamide-imide resin was 6% by mass, and the concentration of the ultraviolet absorbing agent relative to the FEP was 3.8% by mass.

The prepared application liquid was applied, with a wire bar, to one surface of a polyimide sheet (Upilex, made by UBE INDUSTRIES, LTD.) having a thickness of 75 μm so that the film thickness was about 50 μm.

After applying and drying the liquid, a heat treatment was performed thereon at 350 degrees Celsius for four hours to form a water-repellent layer. Thus, a water-repellent sheet was obtained.

The water-repellent sheet was used to measure the RMV.

Holes were drilled in the water-repellent sheet with a laser to form nozzles. The water-repellent sheet was cut into same-size pieces. Thus, nozzle plates were produced.

<Preparation of Ink 1>

(Preparation of Pigment Dispersion D-1)

The compounds below were put in a stainless-steel beaker and stirred for one hour while being heated on a hot plate of 65 degrees Celsius to dissolve.

PB822 (polymer dispersing agent, acid value 18.5 mg/gKOH, amine value 15.9 mg/gKOH, made by AJINOMOTO FINE-TECHNO CO., INC.): 8 parts OXT221 (oxetane compound, made by TOAGOSEI CO., LTD.): 72 parts Subsequently, the solution was cooled to room temperature, and the following pigment was added thereto. Then, the resultant was put into a glass bottle with 200 g of zirconia beads having a diameter of 1 mm, and the bottle was tightly stoppered. Then, a dispersion treatment was performed in a paint shaker for four hours, and the zirconia beads were removed. Thus, the pigment dispersion D-1 was prepared.

(Pigment)

Cyanine Blue 4044 (Pigment Blue 15:4, amine value 8.0 mg/gKOH, acid value 0.0 mg/gKOH, made by SANYO COLOR WORKS, LTD.): 20 parts <Preparation of Ink>

The pigment dispersion D-1 prepared as above was mixed with the additive agents in order as described below to prepare ink 1.

Pigment dispersion D-1: 12.00 parts

OXT-221 (di[1-ethyl(3-oxetanyl)]methyl ether, made by TOAGOSEI CO., LTD.): 65.75 parts SP-152 (triphenylsulfonium salt, made by ADEKA CORPORATION): 0.20 parts Megafax F475 (perfluoroalkyl group-containing acryloligomer, made by DAINIPPON INK AND CHEMICALS, INCORPORATED): 0.05 parts <Preparation of Ink 2>

(Preparation of Pigment Dispersion D-2)

The compounds below were put in a stainless-steel beaker and stirred for three hours while being heated on a hot plate of 50 degrees Celsius to dissolve.

PB822 (polymer dispersing agent, acid value 18.5 mg/gKOH, amine value 15.9 mg/gKOH, made by AJINOMOTO FINE-TECHNO CO., INC.): 8 parts Tetraethylene glycol diacrylate: 72 parts Subsequently, the solution was cooled to room temperature, and the following pigment was added thereto. Then, the resultant was put into a glass bottle with 200 g of zirconia beads having a diameter of 1 mm, and the bottle was tightly stoppered. Then, a dispersion treatment was performed in a paint shaker for four hours, and the zirconia beads were removed. Thus, the pigment dispersion D-2 was prepared.

Cyanine Blue 4044 (Pigment Blue 15:4, amine value 8.0 mg/gKOH, acid value 0.0 mg/gKOH, made by SANYO COLOR WORKS, LTD.): 20 parts (Preparation of Ink)

The pigment dispersion D-2 prepared as above was mixed with the additive agents in order as described below to prepare ink 2.

Pigment dispersion D-2: 14.00 parts

Tetraethylene glycol diacrylate: 31.00 parts

ϵ-caprolactam modified dipentaerythritol hexaacrylate: 30.00 parts

Phenoxy ethyl methacrylate: 20.00 parts

I-907: IRGACURE 907 (made by NIHON CIBA-GEIGY K.K.): 5.00 parts

<Measurement of RMV>

On the basis of the measurement method as shown in the section of (RMV), the RMV was measured with the combination of the water-repellent sheet and the inks 1 and 2.

The measurement results are shown in Table 1.

<Wiping Section>

Figure 2A:
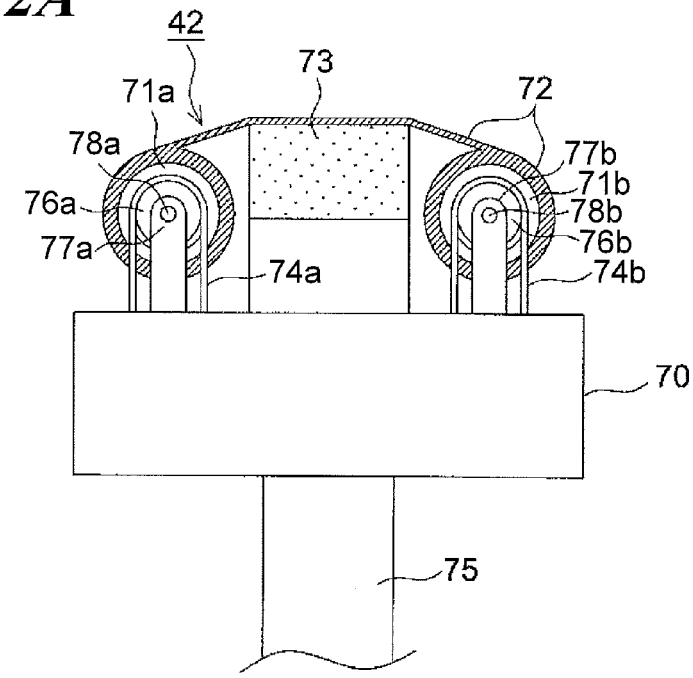
FIG. 2A is a view showing an example of a wiping section.
Figure 2B:
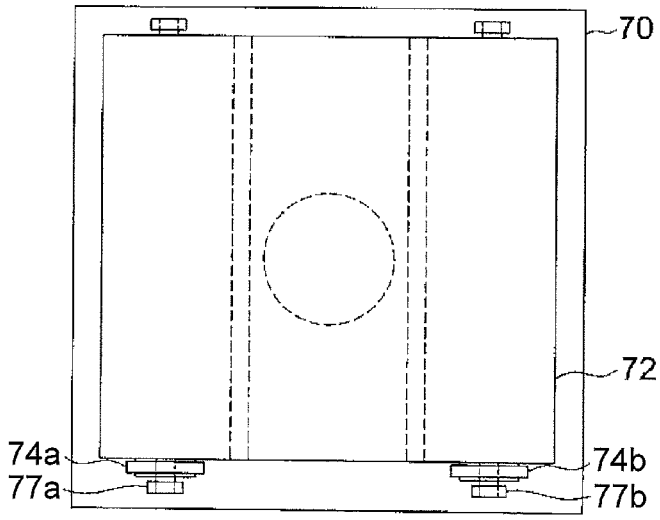
FIG. 2B is a plan view showing an example of the wiping section.

The following cloths and elastic bodies, having the structures shown in FIGS. 2A and 2B, were combined as shown in Table 1, and wiping sections of the examples 1-10 and the comparative examples 2-4 were produced. The support 70 was produced in combination with an aluminum plate.

(Cloth)

W-1: MicroPolx4000HP polyester/nylon knit, made by BERKSHIRE

W-2: SAVINA MX polyester/nylon, made by KB SEIREN, LTD.

W-3: SAVINA DC polyester, made by KB SEIREN, LTD.

(Elastic Body)

E-1: GP (urethane foam; hardness: 30 N), made by BRIDGESTONE CORPORATION

E-2: TH (urethane foam; hardness: 100 N), made by BRIDGESTONE CORPORATION

E-3: JT (urethane foam; hardness: 180 N), made by BRIDGESTONE CORPORATION

E-4: Silicon rubber

E-5: MU (urethane foam; hardness: 2.9 N), made by BRIDGESTONE CORPORATION

E-6: STXC (urethane foam; hardness: 200 N), made by BRIDGESTONE CORPORATION

<Evaluation Method>

The wiping sections of the examples 1-10 and the comparative examples 2-4 were each fixed to the head maintenance device shown in FIG. 1. An inkjet head was filled with the ink of each of the examples 1-10 and the comparative examples 1-4 shown in Table 1. In the examples 1-10 and the comparative examples 2-4, a wiping section was moved toward the nozzle planes, and the inkjet heads 31 were moved along the guide rail 50 at the moving velocity shown in Table 1, with the wiping member being pressed against the nozzle planes. The nozzle planes and the wiping member were thereby moved relative to each other. The evaluation was made as follows.

In the comparative example 2, the cloth of the wiping section was removed, and E-2 was attached to the position of the elastic body so that E-2 was used as a wiping member to contact the nozzle plates. For the rest, the evaluation was made in the same manner as the example 2.

In the comparative example 1, the head maintenance device of the first embodiment of Japanese Patent Publication Laid-Open No. 2006-205712 was used, instead of the wiping section. That is, after wiping with a blade was performed, an ink wiping device was pressed, the device including a cloth, which was exposed on the surface, and a pressing member. Then, the pressing member was moved from behind the cloth without moving the cloth, so as to perform wiping. As the cloth, W-2 was used. For the rest, the evaluation was made in the same manner as the example 1.

(Damage of Nozzle Plane)

The inkjet heads were moved parallel to the nozzle planes 1000 times, while the ink was ejected each time, at each of the moving velocities (RMV×moving velocity coefficient) shown in Table 1, with the wiping section being pressed against the nozzle planes at the pressure of 200 g/cm, so that the wiping member moved relative to the nozzle planes and rubbed the nozzle planes (movement width: 5 cm). The nozzle planes were observed with a microscope, and the judgments were made based on the following criterion.

○: No damage to the water repellent processing is observed.

Δ: Deterioration in the water repellent processing is observed.

X: Peeling-off and scratches are observed in the water repellent processing.

(Residual Droplets)

After the ink was sucked with the suction caps 41 and wiping was performed, the nozzle planes were observed and the evaluation was made as to whether uncured droplets were removed from the nozzle planes based on the following criterion.

◎: After performing the wiping operation twice, ink droplets are not observed on the nozzle planes.

○: After performing the wiping operation three times, ink droplets are not observed on the nozzle planes. (Ink droplets are observed after performing the wiping operation twice).

Δ: After performing the wiping operation four times, ink droplets are not observed on the nozzle planes. (Ink droplets are observed after performing the wiping operation three times).

X: After performing the wiping operation four times, ink droplets are observed on the nozzle planes.

(Residual Semisolid)

Printing was performed continuously for one hour while the UV irradiation sections 21 were performing irradiation with UV. After that, the wiping operation was performed. The nozzle planes after the wiping operation were observed, and ink droplets and semisolid ink drops partially cured by the UV irradiation during the printing, which remained to be wiped, were evaluated.

◎: After performing the wiping operation three times, ink droplets and semisolid ink are not observed on the nozzle planes.

○: After performing the wiping operation five times, ink droplets and semisolid ink are not observed on the nozzle planes. (Partially cured ink is observed after performing the wiping operation three times).

Δ: After performing the wiping operation six times, ink droplets and semisolid ink are not observed on the nozzle planes. (Partially cured ink is observed after performing the wiping operation five times).

X: After performing the wiping operation six times, partially cured ink is observed on the nozzle planes.

The evaluation results are shown in Table 1.

In Table 1, each of the moving velocity coefficients of the wiping section indicates (relative moving velocity)÷RMV.

TABLE 1

| | | | WIPING DEVICE | | | EVALUATION | | | |
|---|---|---|---|---|---|---|---|---|---|
| | INK | RMV | CLOTH | ELASTIC BODY | MOVING VELOCITY COEFFICIENT | DAMAGE OF NOZZLE PLANE | RESIDUAL DROPLETS | RESIDUAL SEMISOLID | NOTE |
| COMPARATIVE EXAMPLE 1 | 1 | 25 mm/s | W-2 | — | — | ○ | ○ | X | COMPARATIVE EXAMPLE |
| COMPARATIVE EXAMPLE 2 | 2 | 20 mm/s | — | E-2 | 0.7 | ○ | X | X | COMPARATIVE EXAMPLE |
| EXAMPLE 1 | 1 | 25 mm/s | W-1 | E-2 | 0.88 | ○ | ◎ | ◎ | PRESENT INVENTION |
| EXAMPLE 2 | 2 | 20 mm/s | W-2 | E-3 | 0.7 | ○ | ◎ | ◎ | PRESENT INVENTION |
| EXAMPLE 3 | 2 | 20 mm/s | W-1 | E-1 | 0.8 | ○ | ◎ | ◎ | PRESENT INVENTION |
| EXAMPLE 4 | 1 | 25 mm/s | W-2 | E-3 | 0.8 | ○ | ◎ | ◎ | PRESENT INVENTION |
| EXAMPLE 5 | 2 | 20 mm/s | W-1 | E-1 | 0.3 | ○ | ◎ | ◎ | PRESENT INVENTION |
| EXAMPLE 6 | 1 | 25 mm/s | W-2 | E-6 | 0.8 | ○ | Δ | Δ | PRESENT INVENTION |
| COMPARATIVE EXAMPLE 3 | 1 | 25 mm/s | W-3 | E-2 | 0.92 | Δ | X | X | COMPARATIVE EXAMPLE |
| COMPARATIVE EXAMPLE 4 | 1 | 25 mm/s | W-2 | E-2 | 0.1 | ○ | ○ | X | COMPARATIVE EXAMPLE |
| EXAMPLE 7 | 2 | 20 mm/s | W-1 | E-4 | 0.7 | ○ | Δ | Δ | PRESENT INVENTION |
| EXAMPLE 8 | 1 | 25 mm/s | W-3 | E-3 | 0.8 | Δ | ◎ | ◎ | PRESENT INVENTION |
| EXAMPLE 9 | 1 | 25 mm/s | W-3 | E-2 | 0.7 | Δ | ◎ | ◎ | PRESENT INVENTION |
| EXAMPLE 10 | 1 | 25 mm/s | W-1 | E-5 | 0.8 | ○ | ○ | Δ | PRESENT INVENTION |

According to Table 1, it is found that, when the cloth as a wiping member and the nozzle planes slide on each other at a relative moving velocity of not less than RMV×0.2 and not more than RMV×0.9, with the cloth being pressed with the elastic body, wiping can be performed without damaging the nozzle planes, and without leaving uncured ink droplets and partially-cured semisolid ink droplets which remain to be wiped. Further, it is found that, when the elastic body is a foamed resin having a hardness of not less than 10 N and not more than 180 N, uncured ink droplets and partially-cured semisolid ink droplets which remain to be wiped can be improved. Further, it is found that, when a cloth includes a polyester fiber and a polyamide fiber, the nozzle planes are not easily damaged.

INDUSTRIAL APPLICABILITY

The present invention can be utilized for a head maintenance device and an inkjet recorder.

The invention claimed is:

1. A head maintenance device comprising a wiping section which wipes a nozzle plane of an inkjet head, wherein a plurality of nozzles to eject ink are provided on the nozzle plane, wherein the wiping section includes a wiping member comprising a cloth, an elastic body and a support, in the order named from a side where the wiping section comes into contact with the inkjet head;

wherein the device is structured to move the cloth parallel to the nozzle plane at a relative moving velocity of not less than RMV×0.2 and not more than RMV×0.9 with respect to the nozzle plane so as to wipe the nozzle plane; and wherein the ink is a curable ink.

2. The head maintenance device according to claim 1, wherein the elastic body is a foamed resin.

3. The head maintenance device according to claim 2, wherein the foamed resin has a hardness of not less than 10 N and not more than 180 N.

4. The head maintenance device according to claim 1, wherein the cloth contains a polyester fiber.

5. The head maintenance device according to claim 1, wherein the cloth contains a polyamide fiber.

6. The head maintenance device according to claim 1, wherein a water-repellent finishing is performed on the nozzle plane.

7. An inkjet recorder comprising the head maintenance device according to claim 1.

* * * * *